US009184499B2

(12) United States Patent
Raczkowski et al.

(10) Patent No.: US 9,184,499 B2
(45) Date of Patent: Nov. 10, 2015

(54) HYBRID BEAMFORMING FOR A WIRELESS COMMUNICATION DEVICE

(71) Applicant: IMEC, Leuven (BE)

(72) Inventors: Jakub Raczkowski, Leuven (BE); Piet Wambacq, Groot-Bijgaarden (BE)

(73) Assignee: IMEC, Leuven (BE)

( * ) Notice: Subject to any disclaimer, the term of this patent is extended or adjusted under 35 U.S.C. 154(b) by 312 days.

(21) Appl. No.: 13/654,090

(22) Filed: Oct. 17, 2012

(65) Prior Publication Data

US 2013/0093624 A1 Apr. 18, 2013

Related U.S. Application Data

(60) Provisional application No. 61/548,405, filed on Oct. 18, 2011.

(51) Int. Cl.
*H01Q 3/00* (2006.01)
*H01Q 3/42* (2006.01)
*H01Q 3/30* (2006.01)

(52) U.S. Cl.
CPC ... *H01Q 3/42* (2013.01); *H01Q 3/30* (2013.01)

(58) Field of Classification Search
USPC ..... 342/154, 368, 372, 373; 370/334; 455/562.1
See application file for complete search history.

(56) References Cited

U.S. PATENT DOCUMENTS

| | | | |
|---|---|---|---|
| 7,904,117 | B2 | 3/2011 | Doan et al. |
| 2004/0043743 | A1 | 3/2004 | Rzyski et al. |
| 2010/0013527 | A1 | 1/2010 | Warnick |

FOREIGN PATENT DOCUMENTS

| | | | |
|---|---|---|---|
| WO | 2010085854 | A1 | 8/2010 |
| WO | 2010149689 | A9 | 12/2010 |

OTHER PUBLICATIONS

European Search Report, European Patent Application No. 12188608.9 dated Mar. 20, 2013.
Tseng, Richard et al., "A Four-Channel Beamforming Down-Converter in 90-nm CMOS Utilizing Phase-Oversampling", IEEE Journal of Solid-State Circuits, vol. 45, No. 11, Nov. 2010, pp. 2262-2272.
Yamaji, Takafumi et al., "A Four-Input Beam-Forming Downconverter for Adaptive Antennas", IEEE Journal of Solid-State Circuits, vol. 38, No. 10, Oct. 2003, pp. 1619-1625.
Chu, Min et al., "CMOS Phase-Shifting Circuits for Wireless Beamforming Transmitters", Analog Integrated circuits and Signal Processing, vol. 54 (1), 2008, pp. 45-54.
Bakr, Omar Mohammed "A Scalable and Cost Effective Architecture for High Gain Beamforming Antennas," Electrical Engineering and Computer Sciences University of California at Berkeley, Dec. 17, 2010, pp. 1-221.

*Primary Examiner* — Dao Phan

(57) ABSTRACT

The present disclosure relates a method for performing hybrid beamforming in a wireless communication device or any device that uses signal phase shifting for transmission and/or reception. The method comprises performing phase shifting in at least two different domains (or paths), each characterized by an operational frequency, in the communication device. More in particular, the disclosure relates in a first aspect to a method for performing at a receiver beamforming on a beam of incoming signals received via plurality of antenna paths. In another aspect, the present disclosure relates a method for performing hybrid beamforming at a transmitter device, wherein also phase shifting in at least two different domains is performed. More in particular, the disclosure also relates to a method for performing at a transmitter device beamforming on a beam of outgoing signals via a plurality of antenna paths.

10 Claims, 5 Drawing Sheets

(a) (b)

HYBRID BEAMFORMING FOR A WIRELESS COMMUNICATION DEVICE

CROSS REFERENCE TO RELATED APPLICATION

The present application claims priority to U.S. Patent Application Ser. No. 61/548,405, filed on Oct. 18, 2011, the entire contents of which are herein incorporated by reference.

TECHNICAL FIELD

The present disclosure is generally related to the field of wireless communication. More particularly, it relates to wireless communication schemes wherein beamforming is employed.

BACKGROUND

It is known that the link's power budget of a radio communication device is greatly enhanced when beamforming is used. As shown in FIG. 1, beamforming involves the use of multiple antennas (as in a phased array). In a transmitter the signal is first distributed over the antennas and then delayed (or phase shifted), where the delay defines the direction of signal transmission, while in the receiver the signal in each antenna path is first delayed, where the delay depends on the direction of reception, and then combined. It is the task of the beamformer to create these delays and add them to the signals of the respective antenna paths.

In the case of narrowband radio communication the delays can be approximated by phase shifts. To realize these phase shifts, circuits called phase shifters (or beamformers) are implemented, operating in one of the major domains of a radio device as shown in FIG. 2. That is, in the radio frequency (RE) domain, in the local oscillator (LO) domain, in the intermediate frequency (IF) domain (not shown in the figure) or in the baseband (BB) domain. In case of a direct-conversion system, the IF domain does not exist; phase shifters are then provided in at least two of the other domains. In any case, the antenna-referred phase shift has to have a range of 360 degrees, to be able to realize any direction of transmission.

Beamforming (BF) applied directly at the radio frequency (RE) (FIG. 2*a*) offers the benefit that the duplication of the different signal operations in a transceiver is kept to a minimum. However, in semiconductor technologies, e.g. in digital CMOS, beamforming at radio frequencies yields high losses which, in addition, depend on the desired phase shift. Moreover, this approach is sensitive to small layout parasitics. These disadvantages render the current RF beamforming techniques not suitable for low noise and ultra-low power radios.

In LO phase shifting (FIG. 2*b*) the phase shift is applied to the LO signal and not in the signal path. In a receiver the high-frequency signal is down-converted with a LO signal that is phase shifted with respect to the LO signals for the other antenna paths. Therefore, multiplication of the LO paths may be desirable, as every mixer in each antenna path needs to be steered by a phase shifted version of the LO signal. After down-conversion, the signals of the different antenna paths are in phase and they can be combined, yielding a signal quality improvement. The implementation in the transmitter may include a split of the signals over the different antenna paths before up-conversion. Then, in each antenna path an up-conversion is performed with a LO signal that is phase shifted with respect to the LO signals in the other antenna paths. Compared to beamforming at radio frequencies (RF), beamforming in the LO path implies a duplication of the down-conversion or up-conversion mixers and routing of the LO signal to the different phase shifters. Just as with RF beamforming, high-frequency power hungry phase shifters are needed, but the noise and gain requirements are alleviated. Again, due to the elevated power consumption, this LO beamforming technique is not suitable for low noise and ultra-low power radio application.

In baseband beamforming the beamforming in the baseband (BB) path can be implemented in analog or digital domain. In analog baseband beamforming (FIG. 2*c*) in systems featuring in-phase and quadrature signalling, the phase-shift adjustment is performed by implementing the operation of matrix rotation of the constellation on a complex plane. The rotation of constellation is equivalent to phase shift when the signal is translated to RF domain (up/down-converted). This operation can be implemented with a set of variable-gain amplifiers, where the rotation of the complex constellation plane is controlled by varying the gain factors of the amplifiers. The beamforming in the digital baseband path (not shown in the figure) can be implemented following the same principle. However, this may include a duplication of the complete analog functionality of a radio (filters, variable-gain amplifiers, ADCs) over all antenna paths, as for every antenna path a dedicated digital path is necessary together with a dedicated digital/analog converter. This in turn leads to excessive power consumption.

For wireless communication at high data rates the 57-66 GHz frequency band is allocated. Transceivers for such communication can advantageously be implemented using highly downscaled CMOS.

In comparison to the RF and LO beamforming implementations, the BB beamforming is the most suitable for CMOS implementations, as it offers improved flexibility, reduced power consumption and area. However, the BB beamforming scenario is not suitable for simple transmission schemes, for example binary phase shift keying (BPSK) and on-off keying (OOK) schemes, where only in-phase signals are used, because it is specifically suited for operation with a quadrature signal, i.e. a signal with in-band (I) and quadrature (Q) components. Moreover, the introduction of variable-gain amplifiers and signal combiners into the baseband path inevitably reduces the signal quality.

To combat the issues of implementing a full-range phase shifter, a combination of a quadrant selection (coarse phase tuning) using phase-shift local oscillator and fine phase-shifting using RF phase shifters technique has been proposed by Chu et al. ("CMOS phase-shifting circuits for wireless beamforming transmitters", Analog Integrated Circuits and Signal Processing, 2008, Vol. 54 (1), pp. 45-54). However, the proposed hybrid beamforming scheme still suffers from high power consumption, high complexity of the circuit, which in turn brings high influence on the quality of the processed signal, and therefore high signal distortion.

It is apparent from the above, that conventional beamforming techniques suffer from high complexity, high power consumption and usually high signal quality degradation. This is mostly because a complex circuit is inserted in the path of the signal. Often, such circuit is implemented so that it introduces losses to the path, inevitably increasing noise and requiring additional amplification. Even if the phase shifting circuitry is not placed in the signal path, but in the path of the local oscillator, the requirement of full phase shifting range brings higher power consumption, area consumption and complexity.

Hence, there is a need for solutions for performing beamforming wherein these problems are overcome.

SUMMARY OF CERTAIN INVENTIVE ASPECTS

It is an object of embodiments of the present disclosure to provide for a hybrid beamforming for a communication device with improved performance. The improvement can be realised in one or more of the following ways: a reduction of power consumption, signal degradation and/or area cost. However, in alternative embodiments the improvement can be realised with respect to yet other performance measures. The presented hybrid beamforming approach is also suitable for communication devices implemented using, but not limited to, CMOS technologies and/or technologies which involve high scalability.

The above objective is accomplished by the solution according to the present disclosure.

The present disclosure relates a method for performing hybrid beamforming in a wireless communication device or any device that uses signal phase shifting for transmission/reception. The method comprises performing phase shifting in at least two different domains (or paths), each characterized by an operational frequency, in the communication device. More in particular, the disclosure relates in a first aspect to a method for performing at a receiver beamforming on a beam of incoming signals received via plurality of antenna paths, comprising the steps of

- performing in each antenna path the steps of
  - a first phase shifting operation on one of the incoming signals or on a local oscillator signal,
  - a mixing of said one incoming signal with the local oscillator signal, said one incoming signal or said local oscillator signal being phase-shifted, thereby obtaining a baseband signal,
  - a second phase shifting operation on the baseband signal,
- combining the phase shifted baseband signals output from the various antenna paths to obtain a received signal to be processed further.

In a second aspect the present disclosure relates a method for performing hybrid beamforming at a transmitter device, wherein also phase shifting in at least two different domains is performed. More in particular, the disclosure also relates to a method for performing at a transmitter device beamforming on a beam of outgoing signals via a plurality of antenna paths, comprising the steps of

- distributing a signal to be transmitted into a plurality of baseband signals, each further handled in one of the antenna paths,
- performing in each antenna path the steps of
  - a first phase shifting operation on one of the baseband signals,
  - a mixing of the phase-shifted baseband signal with a local oscillator signal, whereby a second phase shifting operation is performed on the signal resulting from the mixing or on the local oscillator signal, thereby obtaining one of the outgoing signals.

The disclosure proposes performing beamforming in at least two different domains, therefore it is called hybrid beamforming.

In an additional embodiment the baseband signal phase shifting step is performed on an analog signal. Alternatively, it can be performed on a digital signal.

In an advantageous embodiment the method further comprises an intermediate step of mixing with a further local oscillator signal, thereby obtaining a signal at intermediate frequency. Depending on whether the step is performed at the transmitter or receiver side the mixing occurs with a phase shifted baseband signal or with a signal at a radio frequency that possibly has already undergone a phase shift.

Optionally, in that intermediate step also an additional phase shift operation is performed.

In another embodiment phase shifting is performed with a reduced resolution (i.e. performing phase adjustment with coarse steps) within a complete phase-shifting range or with high resolution within a limited phase-shifting range (i.e. performing phase adjustments with fine steps). This results in performing the phase correction in multiple beamforming stages, wherein at the first stage the phase is shifted with a fine precision within a limited range, and in the second stage the phase is fully adjusted with a coarse precision in the complete phase-shifting range, or vice versa. Combined, the multiple phase shifting adjustments form a hybrid phase shifting, delivering the same phase shifting performance at lower power consumption, lower implementation complexity of the phase shifters and lower signal degradation.

Other aspects of the present disclosure relate to communication devices employing hybrid beamforming. To be more precise, in a third aspect the disclosure relates to a receiver structure for receiving a beam of incoming signals. The receiver structure comprises a plurality of antenna paths, each arranged for handling one of the incoming signals and each comprising

- mixing means arranged for mixing one of the incoming signals with a local oscillator signal and for outputting a baseband signal,
- first phase shifting means arranged for performing a phase shift on the incoming signal or on the local oscillator signal applied to the mixing means,
- second phase shifting means connected to the mixing means and arranged for performing a phase shift on the baseband signal output by the mixing means, whereby the receiver structure further comprises signal combination means in connection with the antenna paths and arranged for combining the phase shifted baseband signals output by the second phase shifting means.

In a fourth aspect the disclosure relates to for transmitting a beam of outgoing signals via a plurality of antenna paths. The transmitter structure comprises distributing means arranged for splitting a signal to be transmitted into a plurality of baseband signals, each antenna path being arranged for handling one of the outgoing signals and comprising

- first phase shifting means arranged for performing a phase shift on one of the baseband signals
- mixing means arranged for mixing one of the phase-shifted baseband signals with a local oscillator signal,
- second phase shifting means arranged for performing a phase shift on the signal output by the mixing means or on the local oscillator signal.

The transmitter or receiver structure comprises in an embodiment, further mixing means arranged for mixing with a further local oscillator signal to produce a signal at intermediate frequency. Optionally further phase shifting means can be provided.

In another embodiment the receiver or transmitter structure as described comprises a multiplication means for transforming a signal with given frequency into a signal at a multiple of the given frequency. In case phase shifting is applied in the local oscillator path, the phase shifting means can be positioned either before or after the multiplication means, i.e. phase shifting can be performed on the local oscillator signal before or after multiplication.

For purposes of summarizing the disclosure and the advantages achieved over the prior art, certain objects and advantages of the disclosure have been described herein above. Of course, it is to be understood that not necessarily all such objects or advantages may be achieved in accordance with any particular embodiment of the disclosure. Thus, for example, those skilled in the art will recognize that the disclosure may be embodied or carried out in a manner that achieves or optimizes one advantage or group of advantages as taught herein without necessarily achieving other objects or advantages as may be taught or suggested herein.

The above and other aspects of the disclosure will be apparent from and elucidated with reference to the embodiment(s) described hereinafter.

DESCRIPTION OF THE DRAWINGS

The disclosure will now be described further, by way of example, with reference to the accompanying drawings, wherein like reference numerals refer to like elements in the various figures.

FIG. 7(*b*) illustrates an implementation of a local oscillator beamformer in accordance with another embodiment.

DESCRIPTION OF CERTAIN INVENTIVE EMBODIMENTS

Figure 1:
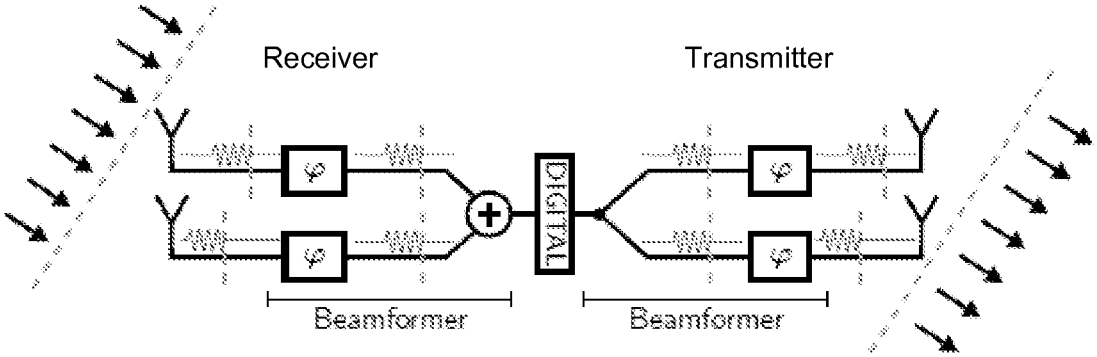
Figure 1 PRIOR ART
FIG. 1 illustrates the conventional concept of beamforming.
Figure 2:
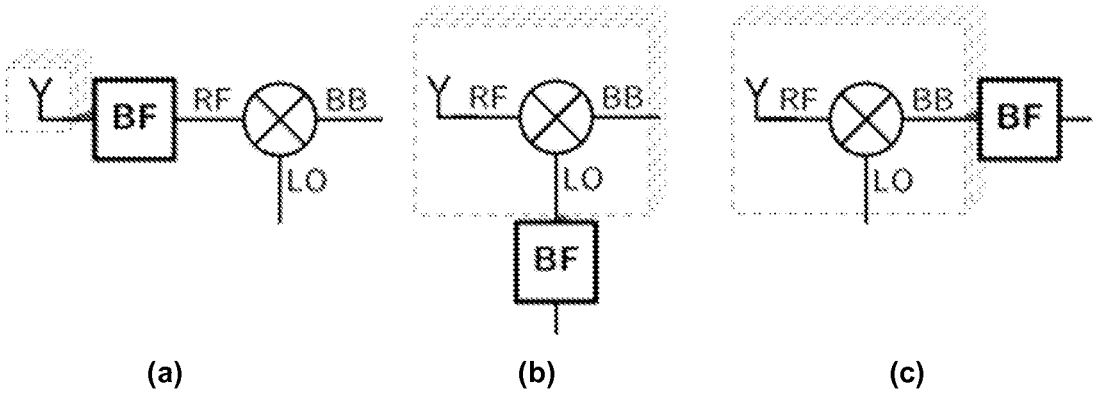
Figure 2 PRIOR ART
FIGS. 2(*a*), (*b*) and (*c*) illustrate wireless receiver structures using conventional beamforming techniques.

The present disclosure will be described with respect to particular embodiments and with reference to certain drawings but the disclosure is not limited thereto but only by the claims.

Furthermore, the terms first, second and the like in the description and in the claims, are used for distinguishing between similar elements and not necessarily for describing a sequence, either temporally, spatially, in ranking or in any other manner. It is to be understood that the terms so used are interchangeable under appropriate circumstances and that the embodiments of the disclosure described herein are capable of operation in other sequences than described or illustrated herein.

It is to be noticed that the term "comprising", used in the claims, should not be interpreted as being restricted to the means listed thereafter; it does not exclude other elements or steps. It is thus to be interpreted as specifying the presence of the stated features, integers, steps or components as referred to, but does not preclude the presence or addition of one or more other features, integers, steps or components, or groups thereof. Thus, the scope of the expression "a device comprising means A and B" should not be limited to devices consisting only of components A and B. It means that with respect to the present disclosure, the only relevant components of the device are A and B.

Reference throughout this specification to "one embodiment" or "an embodiment" means that a particular feature, structure or characteristic described in connection with the embodiment is included in at least one embodiment of the present disclosure. Thus, appearances of the phrases "in one embodiment" or "in an embodiment" in various places throughout this specification are not necessarily all referring to the same embodiment, but may. Furthermore, the particular features, structures or characteristics may be combined in any suitable manner, as would be apparent to one of ordinary skill in the art from this disclosure, in one or more embodiments.

Similarly it should be appreciated that in the description of exemplary embodiments of the disclosure, various features of the disclosure are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed disclosure requires more features than are expressly recited in each claim. Rather, as the following claims reflect, inventive aspects lie in less than all features of a single foregoing disclosed embodiment. Thus, the claims following the detailed description are hereby expressly incorporated into this detailed description, with each claim standing on its own as a separate embodiment of this disclosure.

Furthermore, while some embodiments described herein include some but not other features included in other embodiments, combinations of features of different embodiments are meant to be within the scope of the disclosure, and form different embodiments, as would be understood by those in the art. For example, in the following claims, any of the claimed embodiments can be used in any combination.

It should be noted that the use of particular terminology when describing certain features or aspects of the disclosure should not be taken to imply that the terminology is being re-defined herein to be restricted to include any specific characteristics of the features or aspects of the disclosure with which that terminology is associated.

In the description provided herein, numerous specific details are set forth. However, it is understood that embodiments of the disclosure may be practiced without these specific details. In other instances, well-known methods, structures and techniques have not been shown in detail in order not to obscure an understanding of this description.

Figure 3:
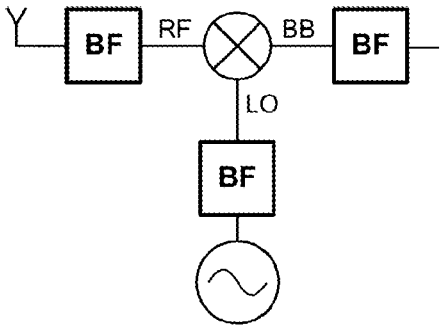
FIG. 3 illustrates one example of a wireless receiver in accordance with an embodiment of the present disclosure.

In embodiments of the present disclosure a hybrid beamforming scheme is proposed, wherein the beamforming is performed in at least the baseband path and in another domain in the communication device (see FIG. 3). For simplicity the figure only a shows schematic system view of a receiver device, and it shall be understood that a transmitter has just an inverse data signal flow. The central component of a system as in FIG. 3 is a mixer. In the mixer three subsystems meet (electrically, but in fact also physically): the RF path (between the antenna and the mixer), the LO path (between the phase-locked loop and the mixer) and the baseband (BB) path (between the mixer and the rest of baseband processing chain). The figure illustrates three possible locations for implementing a phase shift, each related to the position with respect to the mixer, i.e. in the signal path at radio frequency (RF), in the local oscillator (LO) path and in the baseband (BB) path. Apart from solutions with direct conversion from RF to baseband, a further option is to use indirect conversion to an IF frequency with phase shifting performed in the IF path. Splitting the phase-shifting in the baseband domain and at least one other domain, provides a simpler circuit implementation, leading to lower power consumption, reduced area and improved signal fidelity (i.e. signal to noise and distortion ratio-SNDR). In some embodiments the phase shift is realized in two stages, i.e. with fine-grain phase shifting steps and with coarse-grain phase shifting steps (e.g. by quadrature switching). For example, if one of the phase shifters uses quadrature switching with full phase-shifting range and 90 degrees step, then the range of the fine-grain phase shifter is reduced to less than 90 degrees. That is, if the signal is to be phase-shifted with Z degrees (e.g. 225°), it is first fine-grain shifted by X degrees (45°) and then coarse-grain shifted by Z-X degrees (i.e. 180°).

Figure 4A:
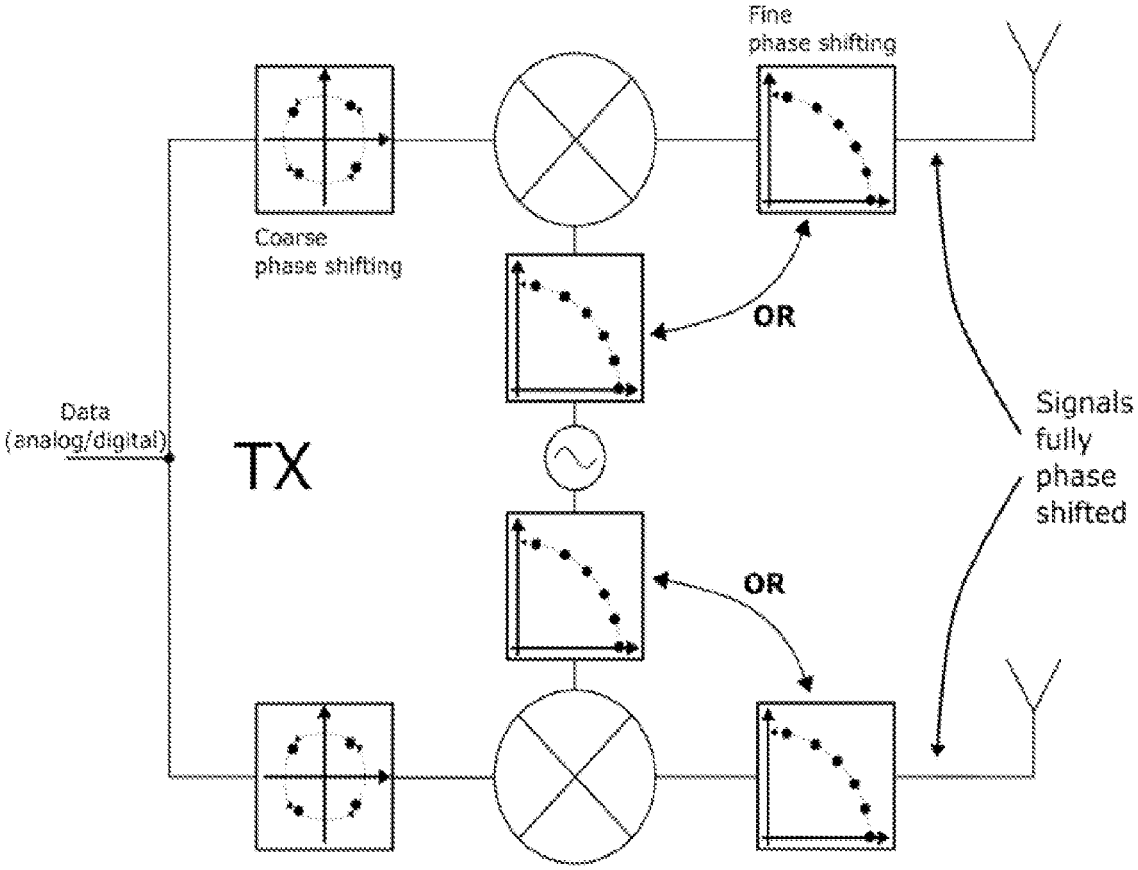
FIG. 4A is for the transmitter side and FIG. 4B for the receiver side.
Figure 4B:
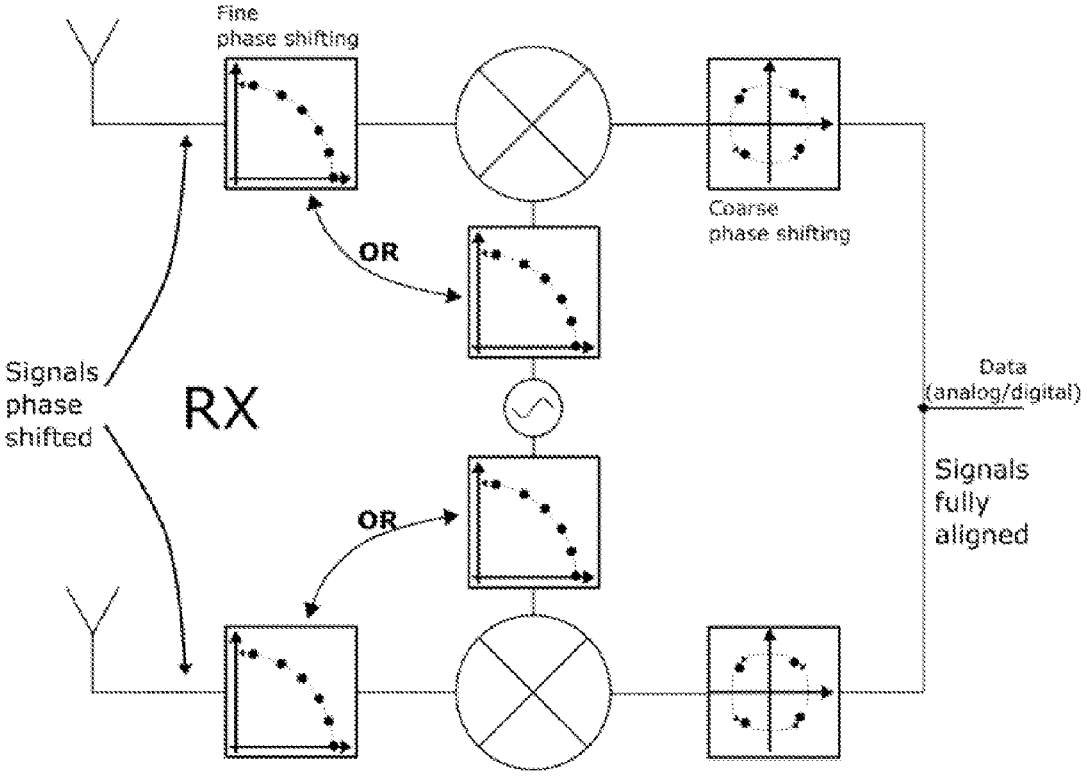
FIG. 4 illustrates an approach according to the present disclosure.

The proposed hybrid beamforming approach may combine phase-shifting performed in the signal path at radio frequency, i.e. at the RF or LO domain, and in the signal path of baseband frequency, i.e. at the baseband path, i.e. in the receiver, after the down-conversion of the RF signal to BB signal, and in the transmitter before the up-conversion of the BB signal to RF signal. FIG. 4 shows a scheme illustrating an approach according to the present disclosure. FIG. 4A is for the transmitter side and FIG. 4B for the receiver side. One phase shifting operation (the coarse phase shift) is performed in the baseband domain, while at least a second operation to implement a fine phase shift is performed either in the local oscillator path or in the RF domain.

By splitting the beamforming into multiple stages, i.e. into a coarse-grain (e.g. quadrature switching), and a fine-grain phase-shifting, the hybrid beamforming approach alleviates the disadvantages of both phase-shifting at radio frequency and at baseband frequency when implemented alone.

In one embodiment, in a hybrid scenario, the phase-shifter in the radio frequency signal path or the local oscillator signal path may perform a fine-grain phase-shifting, i.e. that is adjusting the phase with fine steps of, for example, 5 degrees. Further, the phase-shifting at the radio frequency signal path or the local oscillator signal path may be performed within a limited range, i.e. it may operate only in one quadrant, for example, 0-90 degrees.

The BB phase shifter may perform a coarse-grain phase adjustment with, for example, a step of 90 degrees (as for example in a quadrature switching implementation), and further, it may operate in a complete phase-shifting range, i.e. 0-360 degrees.

In certain embodiments the proposed hybrid beamforming scheme is a combination of a local oscillator phase-shifting and a baseband beamforming. When taken alone, both schemes are appealing to be implemented in semiconductor technologies, as explained in the background section. However they have their drawbacks. The LO phase shifting, for example, is very power hungry as it operates at radio frequency (the same applies for the RF beamforming), i.e. 60 GHz, and the baseband phase shifting suffers from reduced dynamic range since the signal path is extended with additional functional blocks. By applying phase shifting in (at least) two domains as in the present disclosure, the benefits that each phase shifting approach offers when implemented alone can be combined, while their disadvantages can be minimized or avoided.

In other embodiments the hybrid beamforming is implemented as a combination an RF and a BB beamforming.

The implementation of each of the beamforming techniques in a hybrid beamforming scenario is discussed below, starting with baseband beamforming, which is present in any embodiment of the disclosure.

The baseband beamforming can be implemented in the analog or digital domain. The analog baseband phase shifting operates directly on the signals forming the data constellation. In this case, the phase shift is analogous to constellation rotation. Therefore, the analog BB beamforming implements a way of rotating the constellation in opposite direction. This can be seen as implementing a rotation matrix as shown below.

$$\begin{bmatrix} \cos(\varphi) & -\sin(\varphi) \\ \sin(\varphi) & \cos(\varphi) \end{bmatrix} \tag{1}$$

Conventional implementation of BB beamforming is entirely based on variable gain amplifiers generating the necessary components of the rotation matrix. The main issues with such implementation are:

(1) the signal path is extended with variable gain amplifiers (VGAs) and signal combiners, yielding reduced signal quality, and (2) extensive care has to be taken to make sure that the amplitudes of the output signals are not altered, i.e. the equality $\sqrt{\cos^2\phi+\sin^2\phi}=1$ must be met for the cos( ) and sin( ) generated by the VGAs.

Figure 5:
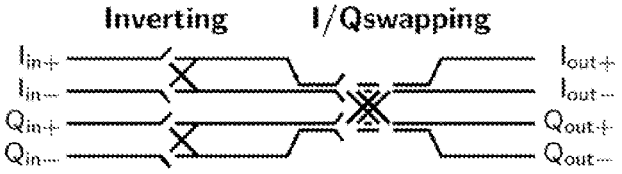
FIG. 5 illustrates a possible implementation of a baseband beamformer in accordance with an embodiment of the present disclosure.

In the proposed hybrid scenario, only coarse-grain phase shifting, e.g. by means of quadrature switching, at the baseband path needs to be realized. Fine phase tuning is introduced in one of the other signal paths, i.e. RF or LO path. This greatly simplifies the coarse phase shifter implementation. In this case, the phase shifts may be realized by simple switching of the signal lines. In that case, either the polarity of the signals is inverted (resulting in 180° of phase shift), which is achieved by simply swapping the differential lines ($I^+$ with $I^-$ or $Q^+$ with $Q^-$), or the I and Q components are swapped, resulting in 90° of phase shift. FIG. 5 shows conceptually an example of the signal swapping action. Here, the swapping operation may be performed by a series of switches which may be operated, for example, by digital gates. Because, the behaviour of this BB phase shifter is purely digital there is no calibration required, as in the case when VGAs are used. Further, such implementation based entirely on switches, the power consumption is practically zero and the signal path is shorter (no VGAs, no buffers), which reduces the signal degradation.

In RF beamforming a phase shift is compensated e.g. by introducing a variable delay in the path by means of switchable transmission lines, each with a different length. This approach implements a true time delay, meaning that the phase shift is progressive with frequency, which is important for a system utilizing very wide signal bandwidth, as the beamformed signal is free of phase distortion. As the total length of the transmission lines has to be equal to the wavelength, the system occupies a large area. Further, introducing longer lines into the signal path introduces signal losses which reduce the signal fidelity and also may benefit from compensation by means of additional amplification stages.

Figure 6:
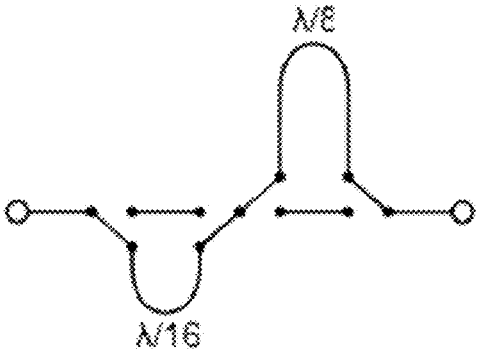
FIG. 6 represents one possible implementation of a radio frequency beamformer in accordance with an embodiment of the present disclosure.

In the proposed hybrid beamforming scenario, the circuitry implementation of a RF phase-shifter is greatly simplified, as it includes circuitry implementation only for a limited phase-shifting range (see FIG. 6). As shown in the figure, only two different transmission lines with length of, e.g. $\lambda/8$ and $\lambda/16$ are used, which allows for adjusting the phase shift with fine steps of λ/16 within a limited range, e.g. 0-90 degrees. Such implementation improves the power consumption and reduces the area cost significantly. Further, the path losses, hence the signal degradation, are minimized as the number of switches operating at radio frequency is minimized as well. Instead of adapting the transmission line lengths various other solutions are available in the art to realise phase shifting in the RF path, which can readily be applied in the proposed approach.

Figure 7:
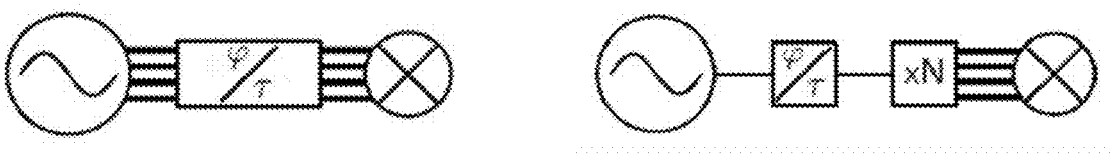
FIG. 7(*a*) illustrates an implementation of a local oscillator beamformer in accordance with an embodiment of the disclosure.

The phase shifts in the LO path can be implemented by introducing small delays on the LO signal, which may be generated by any conventional voltage-controlled oscillator (VCO), an injection locked VCO or by a sub-harmonic injection locked VCO. In the case of a conventional VCO (FIG. 7*a*), small delays are introduced directly in the radio-frequency signal (i.e. 60 GHz), while for the sub-harmonic injection locked VCO (FIG. 7*b*), small delays are introduced in the intermediate frequency (IF) signal (e.g. 12 GHz) used for the sub-harmonic locking of the VCO, i.e. the beamformer block (ϕ/τ) is placed before the IF signal upscaling to RF. In case the RF signal comprises I and Q components a quadrature VCO or a quadrature sub-harmonic injection locked VCO may be used instead.

In the proposed hybrid beamforming scenario, this implies the LO phase shifter may cover only one quadrant of the phase shifting circle (e.g. 0-90 degrees). This means, a fine phase tuning is implemented without extending the signal path while amplitude variations between the phase shifting steps can be neglected. If a quadrature VCO is used, this allows for direct access to the I/O components of the LO signal. Further, if the LO distribution network is built with a sub-harmonically locked mechanism, the phase shift may be imposed directly on the intermediate frequency signal (FIG. 7*b*), e.g. at 12 GHz, that is then multiplied to 60 GHz. Hence, the total range of the phase shifts (ϕ/τ) introduced in the intermediate frequency signal is only (12 GHz/60 GHz)=18°. This greatly reduces the phase-shifting range, resulting in power savings.

Combined, the phase shifting at radio-frequency (RF, LO) and baseband phase shifting form a hybrid phase shifting delivering the same phase shifting performance at lower power consumption and area costs, simplified circuitry implementation and lower signal degradation.

Figure 8:
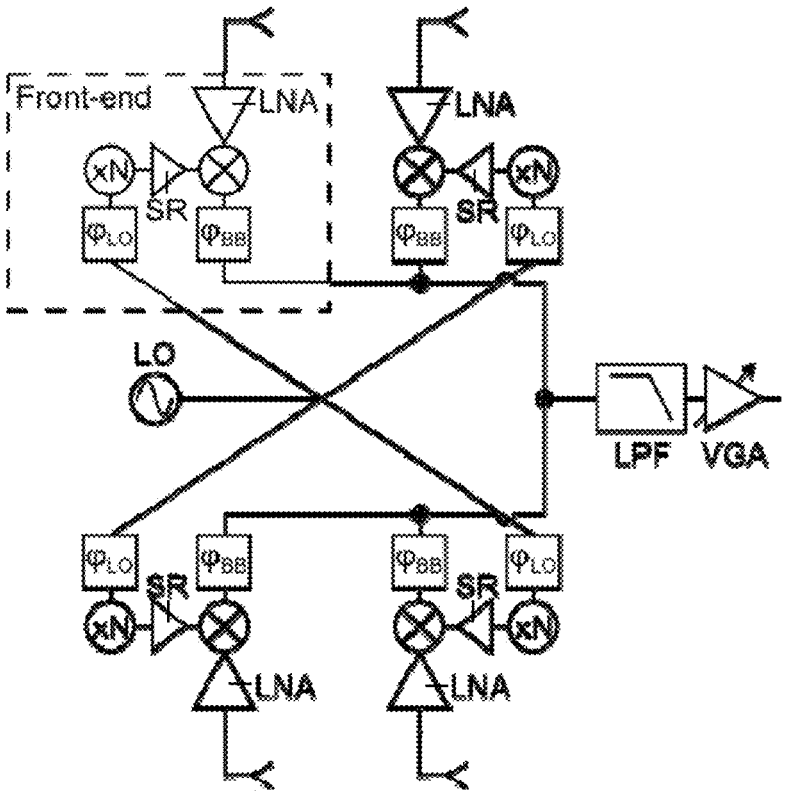
FIG. 8 illustrates a possible system configuration for implementing hybrid beamforming in a wireless receiver.

FIG. 8 shows a possible system implementation of the proposed hybrid beamforming in a wireless receiver. The system comprises four identical front-end blocks, wherein hybrid beamforming is realised at the LO path ($\phi_{LO}$) and at the BB path ($\phi_{BB}$) in accordance with embodiments of the present disclosure. The system implements a sub-harmonic injection locked VCO (LO) operating at 12 GHz, wherein fine phase tuning is introduced directly in the sub-harmonic signal which is then scaled up to radio frequency by the multiplication block (xN), producing a fine phase shifted LO signal. The fine phase shifted LO signal, which may be buffered in the signal replicator (SR), is then mixed with the signal from the antenna, producing a fine phase shifted BB signal. This BB signal is further coarse phase shifted in the $\phi_{BB}$. Then, the signals from the different antenna paths are combined. Optionally, the baseband signal may be further low-pass filtered (LPF) and amplified (VGA). Advantageously, the proposed system is also scalable—it is constructed in a way that allows further scaling of the number of antenna paths. Here, the main scalability feature is the creation of an almost standalone 60 GHz down-conversion subsystem for each antenna path. Adding additional antenna paths simply includes a repetition of the front-end subsystem.

The total power consumption of the proposed hybrid LO and BB beamforming implementation of this four-path phased array wireless receiver, realized in 90 nm GP CMOS technology, is 22 mW (4×12 GHz LO phase shifter)+16 mW (BB beamformer with signal combiners). A similar, however less optimal, power consumption can be achieved when hybrid RF and BB beamforming is used instead.

The proposed hybrid beamforming schemes may be implemented, for example, in various semiconductor technologies, such as CMOS, BiCMOS, GaAs and others.

Figure 9:
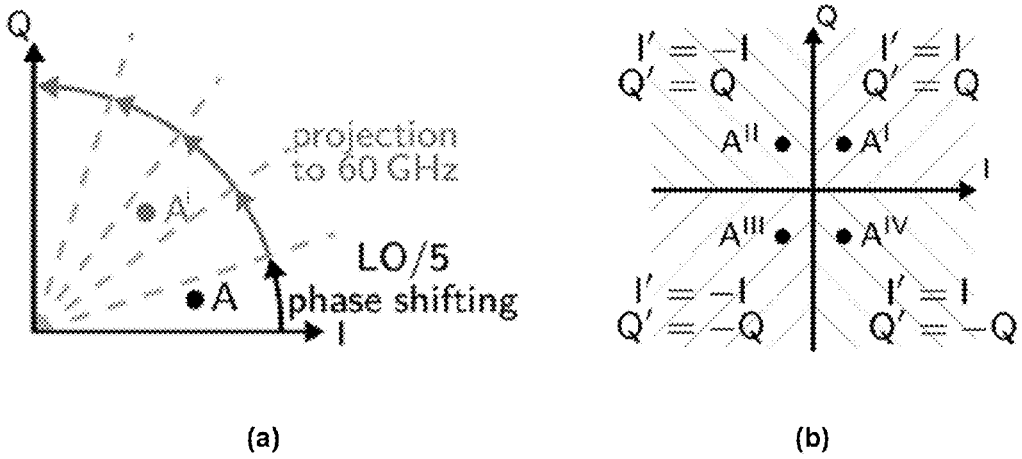
FIG. 9(*a*) illustrates a concept of fine-grain phase-shifting in accordance with an embodiment of the disclosure, while FIG. 9(*b*) illustrates a concept of coarse-grain phase-shifting.

FIG. 9 graphically explains the effects of phase shifting in the signal path at radio-frequency (RE, LO) and in the signal path at baseband frequency (BB). FIG. 9A shows the fine-grain phase shifting, that may be performed by the proposed RF or LO beamformer. More specifically, FIG. 9*a* illustrates the specifics of a fine phase tuning in LO path when a sub-harmonic injection locked VCO is used. The phase-shifting is implemented by weighing the I and Q components with different coefficients, both in the range from 0 to 1, such that, when combined, a phase-shift of for example 5 degrees, is achieved. A phase-shift of A degrees (e.g. 15°) is initially introduced in the sub-harmonic signal, which after its conversion to 60 GHz, results in phase-shift translation ($A^I$, i.e. 15°×5=75°. This projection comes from the fact that a same delay corresponds to different phase shifts at different frequencies. That is, the scale of projection is proportional to the ratio between the introduced phase shifts at different frequencies. Therefore, the phase shifting range is greatly reduced. FIG. 9*b* shows how this induced phase shift ($A^I$) can be further translated to cover all four quadrants ($A^{II}$-$A^{IV}$) by application of baseband quadrature switching, i.e. by simple negation of either I or Q.

The proposed hybrid phase shifting advantageously leads, among others, to a shorter signal path, and/or lower circuitry complexity, and/or lower power consumption and/or area. It is, therefore suited for a low power phased array.

While the disclosure has been illustrated and described in detail in the drawings and foregoing description, such illustration and description are to be considered illustrative or exemplary and not restrictive. The foregoing description details certain embodiments of the disclosure. It will be appreciated, however, that no matter how detailed the foregoing appears in text, the disclosure may be practiced in many ways. The disclosure is not limited to the disclosed embodiments.

Other variations to the disclosed embodiments can be understood and effected by those skilled in the art in practicing the claimed disclosure, from a study of the drawings, the disclosure and the appended claims. In the claims, the word "comprising" does not exclude other elements or steps, and the indefinite article "a" or "an" does not exclude a plurality. A single processor or other unit may fulfil the functions of several items recited in the claims. The mere fact that certain measures are recited in mutually different dependent claims does not indicate that a combination of these measures cannot be used to advantage. A computer program may be stored/distributed on a suitable medium, such as an optical storage medium or a solid-state medium supplied together with or as part of other hardware, but may also be distributed in other forms, such as via the Internet or other wired or wireless telecommunication systems. Any reference signs in the claims should not be construed as limiting the scope.

The invention claimed is:

1. A method for performing beamforming on a beam of incoming signals received via a plurality of antenna paths, comprising:

performing in each antenna path:

a first phase shifting operation on one of said incoming signals or on a local oscillator signal, wherein the first phase shifting operation is performed by quadrature shifting, a mixing of said one incoming signal with said local oscillator signal, said one incoming signal or said local oscillator signal being phase-shifted, thereby obtaining a baseband signal, and a second phase shifting operation on said baseband signal, wherein the second phase shifting operation is a phase shifting of less than 90 degrees, and combining the phase shifted baseband signals output from the various antenna paths to obtain a received signal to be processed further.

2. The method of claim 1, wherein the signal for baseband signal phase shifting is analog.

3. The method of claim 1, wherein the signal for baseband signal phase shifting is digital.

4. The method of claim 1, further comprising an intermediate step of mixing with a further local oscillator signal, thereby obtaining a signal at intermediate frequency.

5. The method of claim 4, whereby in said intermediate step also a phase shifting operation is performed.

6. The method of claim 1, wherein either the first or second phase shifting operation is performed with a resolution below maximum resolution.

7. The method of claim 1, wherein either the first or second phase shifting operation is performed with maximum resolution on only a part of the phase range.

8. Receiver structure for receiving a beam of incoming signals, said receiver structure comprising a plurality of antenna paths, each arranged for handling one of the incoming signals and each comprising:

mixing means arranged for mixing one of the incoming signals with a local oscillator signal and for outputting a baseband signal, first phase shifting means arranged for performing a phase shift on the incoming signal or on the local oscillator signal applied to said mixing means, wherein the first phase shifting means is configured to perform quadrature shifting, and second phase shifting means connected to said mixing means and arranged for performing a phase shift on said baseband signal output by said mixing means, wherein the second phase shifting means is configured to perform a phase shifting of less than 90 degrees, said receiver structure further comprising signal combination means in connection with said antenna paths and arranged for combining the phase shifted baseband signals output by said second phase shifting means.

9. The receiver structure of claim 8, comprising multiplication means for transforming said local oscillator signal with a given frequency into a local oscillator signal at a multiple of said given frequency.

10. The receiver structure of claim 8, comprising further mixing means arranged for mixing with a further local oscillator signal to produce a signal at an intermediate frequency.

* * * * *